United States Patent [19]

Hollweck

[11] 4,136,569

[45] Jan. 30, 1979

[54] THERMOSTAT RESETTING DEVICE

[75] Inventor: Walter Hollweck, Nüremberg, Fed. Rep. of Germany

[73] Assignee: Inter Control, Nüremberg, Fed. Rep. of Germany

[21] Appl. No.: 731,750

[22] Filed: Oct. 12, 1976

[30] Foreign Application Priority Data

Oct. 11, 1975 [DE] Fed. Rep. of Germany ..... 2545640

[51] Int. Cl.[2] ..... G05G 17/00; G05G 1/02

[52] U.S. Cl. ..... 74/2; 74/110; 74/403; 124/10; 200/340

[58] Field of Search ..... 74/2, 403, 110; 124/10, 124/17, 21, 26, 27, 41 R; 200/159 R, 328, 340; 337/56, 91, 348, 367

[56] References Cited

U.S. PATENT DOCUMENTS

| | | | |
|---|---|---|---|
| 1,463,894 | 8/1923 | Jaffe | 124/10 |
| 2,412,235 | 12/1946 | Denberg et al. | 74/2 X |
| 2,530,938 | 11/1950 | Breuning | 74/2 X |
| 2,539,328 | 1/1951 | Sabatini et al. | 74/110 X |
| 2,911,503 | 11/1959 | Garbers | 337/56 |
| 3,187,145 | 6/1965 | Grabinski | 337/56 |
| 3,715,699 | 2/1973 | Hire | 337/367 X |

*Primary Examiner*—Allan D. Herrmann
*Attorney, Agent, or Firm*—Spencer & Kaye

[57] ABSTRACT

A resetting device coupled to a thermostat which has a resetting pin actuated by depressing the same, comprises a body arranged to be movable towards and away from the resetting pin; a propelling device for launching the body in the direction of the resetting pin for depressing the resetting pin by the body in an impact-like manner; and an operating arrangement movable into an actuating position for actuating the propelling device. The resetting pin is freely movable subsequent to the impact-like engagement by the body, irrespective of the momentarily-assumed position of the operating arrangement.

5 Claims, 3 Drawing Figures

THERMOSTAT RESETTING DEVICE

BACKGROUND OF THE INVENTION

This invention relates to a resetting device for a thermostat. The thermostat is of the type that has a switch housing, electric contacts, an arcuate bimetal disc which, upon reaching a predetermined temperature, abruptly changes its arcuate height, an actuating pin which transmits the change in path of the bimetal disc to the movable switch contact and a resetting pin which is displaceably arranged in the housing and by means of which the bimetal disc or the switch contact, as the case may be, can be reset into the original, closed position to re-establish current flow subsequent to the shutoff operation.

In known arrangements of the above-outlined type the thermostat is reset by applying a manual pressing force directly to the resetting pin. The manual force exerted on the resetting pin is, in these arrangements, directly transmitted to the bimetal disc or to the switch contacts.

It is a disadvantage of these prior art arrangements that upon intentionally depressing the resetting pin and maintaining it in the depressed position by the operator, the thermostat is not capable of normal operation because the bimetal disc is forcibly held in its "electric circuit closed" position and thus the thermostat will not interrupt the electric current when the predetermined temperature is reached. This constitutes a dangerous situation for the user of the electric appliance with which the thermostat is associated and therefore in various household appliances it is a requirement to provide the thermostat with a circuit breaking arrangement which provides for a current shutoff even in the depressed state of the manually engaged resetting button.

SUMMARY OF THE INVENTION

It is an object of the invention to provide an improved thermostat resetting device which ensures that the thermostat resumes its normal operation immediately after the resetting pin is actuated, regardless of the position of the push button.

This object and others to become apparent as the specification progresses, are accomplished by the invention, according to which, briefly stated, the resetting device coupled to a thermostat which has a resetting pin actuated by depressing the same comprises a body arranged to be movable towards and away from the resetting pin; a propelling device for launching the body in the direction of the resetting pin for depressing the resetting pin by the body in an impact-like manner; and an operating arrangement movable into an actuating position for actuating the propelling device. The resetting pin is freely movable subsequent to the impact-like engagement by the body irrespective of the momentarily-assumed position of the operating arrangement.

DESCRIPTION OF THE PREFERRED EMBODIMENT

Figure 1:
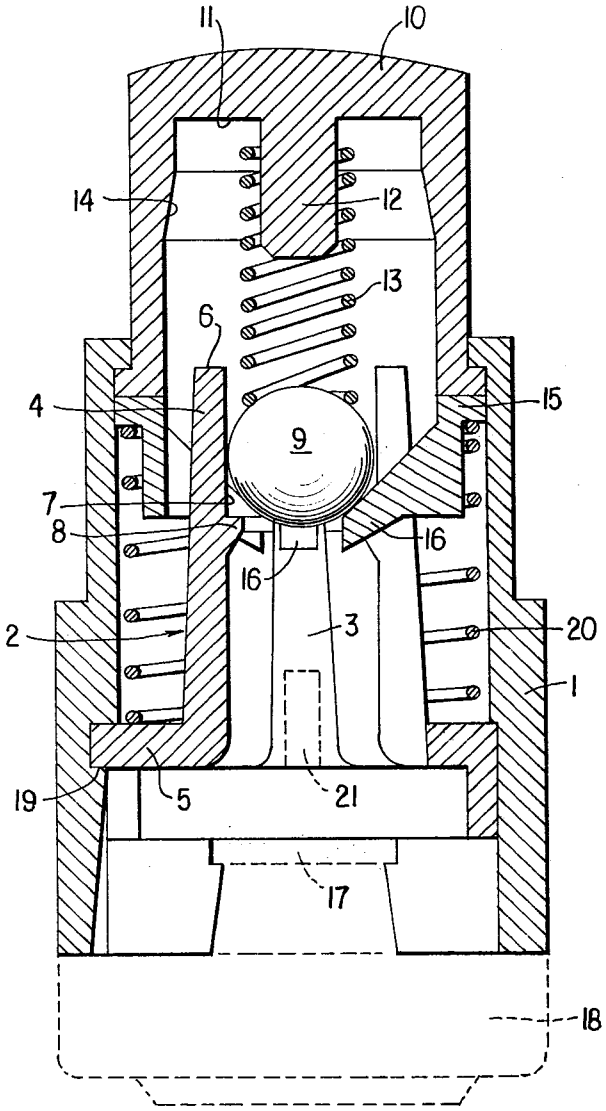
FIG. 1 is a longitudinal sectional view of a preferred embodiment of the invention, showing the structure in its position of rest, prior to operation.

Turning now to FIG. 1, the thermostat resetting device shown therein comprises a housing 1 in which there is held a tubular retaining member 2. The latter is provided with a plurality of longitudinally extending parallel slots 3 arranged in a circumferential array to divide the tubular portion of the retaining member 2 into a plurality of parallel-arranged resilient fingers 4. The fingers 4 are connected to one another at one end to form a socket structure 5 immobilized inside the housing 1, for example, by means of recesses 19 which are provided in the housing 1 and into which the socket 5 may be snapped. The opposite end 6 of the fingers 4 is free and thus this terminus is adapted to resiliently move in a direction transverse to the length dimension of the fingers. At approximately the middle of their length dimension, the resilient fingers 4 have, at their inwardly-oriented wall 7, inwardly projecting detents 8. A spherical body 9 is disposed in the space surrounded by the resilient fingers 4. A hollow, generally thimble-shaped push buttom 10 is slideably secured to the housing 1 for a motion generally parallel to the length dimension of the resilient fingers 4. The push button 10 has a floor 11 from the central portion of which there extends, towards the sphere 9, a post 12 which supports one terminus of a coil spring 13. The other terminus of the coil spring 13 cooperates with the spherical body 9. The inner wall of the push button 10 has a conical portion 14 which tapers towards the floor 11.

Within the housing 1 there is further slidably arranged a return sleeve 15 which surrounds the resilient fingers 4 and which is in engagement with a terminal face of the push button 10. The return sleeve 15 has a plurality of inwardly directed lifting lugs 16 which project into the slots 3 and extend behind the sphere 9. A coil spring 20 is in engagement with the fixed socket member 5 and, with its other, opposite terminus, engages a flanged portion of the return sleeve 15, thus urging both the return sleeve 15 and the push button 10 into their limit position (position of rest) shown in FIG. 1.

The end portion of the housing 1, remote from the push button 10, has recesses 17 which receive one part of a thermostat 18 shown only in phantom lines. The recesses 17 permit a mechanical connection with the housing 1 without any additional securing means. A resetting pin 21 forming part of the thermostat 18 projects in the zone of the socket member 5 into the space defined by the resilient fingers 4.

In the description which follows, the operation of the above-described thermostat resetting device will be discussed, particularly in conjunction with FIGS. 2 and 3.

Prior to starting the resetting operation, the device is in its normal position (position of rest) as shown in FIG. 1.

It is now assumed that the thermostat 18 has just responded to a temperature limit and, as a result, by means of its snap-type bimetallic member, has opened an electric circuit, as outlined above. The resetting pin 21 is now in an advanced position; for closing the circuit it is necessary to reset the thermostat by depressing the resetting pin 21; for this purpose the push button 10 is manually depressed.

As the push button 10 travels into the housing 1, it displaces the return sleeve 15 against the force of the coil spring 20. The lifter lugs 16, forming part of the return sleeve 15, thus move further away from the ball 9, liberating a path of motion therefor. At the same time, the coil spring 13 starts to exert a force on the sphere 9 in the direction of the resetting pin 21. A motion of the sphere 9 towards the resetting pin 21, however, is resisted by the detents 8 of the resilient fingers 4.

As the push button 10 is moved further into the housing 1, the end of the post 12 engages the sphere 9 and thus a rigid force path between the push button and the sphere 9 is established. As a result, the sphere 9 is now positively moved against the detents 8 and the resiliency of the fingers 4, whereupon the latter gradually spread apart by the wedging effect of the advancing sphere 9. This forced downward motion of the sphere 9 proceeds until the equator of the sphere 9 passes the spreading detent. This moment is depicted in FIG. 2 which also shows that by this time the lifter lugs 16 of the return sleeve 15 have travelled sufficiently far as to entirely clear the path for a movement of the sphere 9 to the resetting pin 21. The obstruction (that is, the detents 8) in the path of motion of the sphere 9 spring-biases ("loads") the latter by virture of the resilient force exerted on the sphere 9 by the coil spring 13 and the resilient fingers 4. Stated differently, in this operational phase, a potential energy is imparted to the sphere 9 at a distance from the resetting pin 21. This potential energy reaches its maximum value as the equator of the sphere 9 reaches the detents 8.

Figure 2:
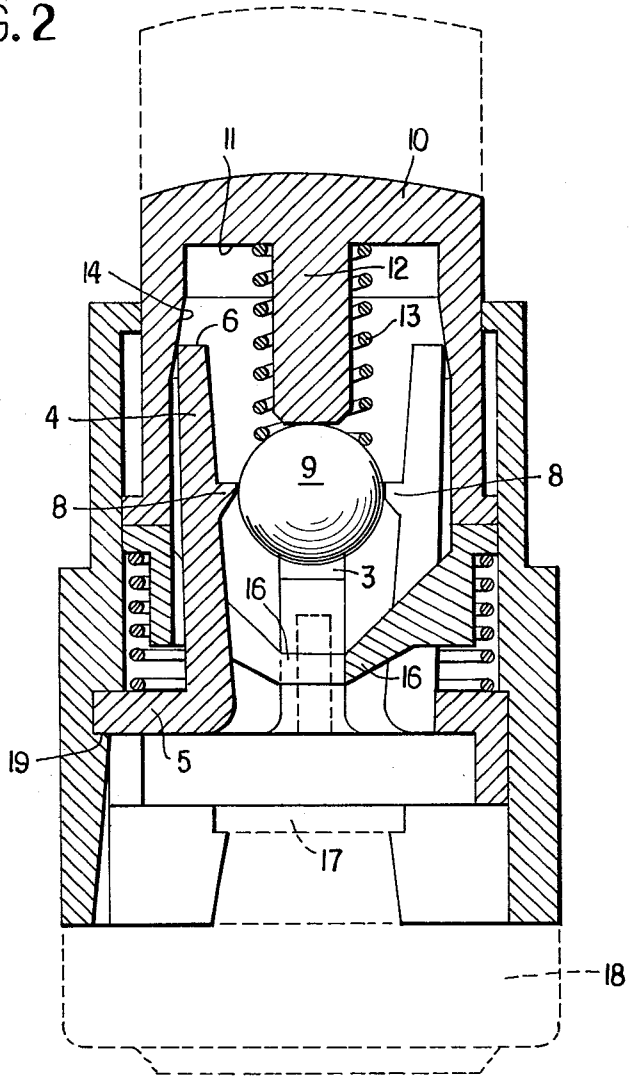
FIGS. 2 and 3 are longitudinal sectional views of the embodiment, showing the latter in successive phases of operation.
Figure 3:
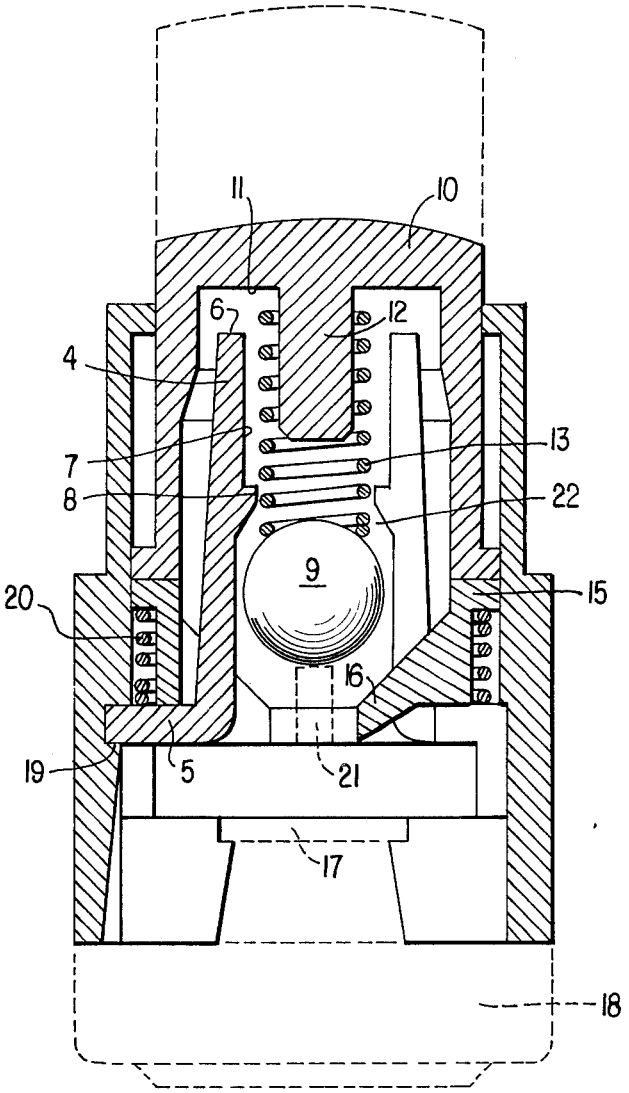

As it may be further observed in FIG. 2, the laterally outward displacement of the resilient fingers 4 in response to the wedging (spreading) effect of the travelling sphere 9 is stopped by the conical wall portion 14 of the push button 10; this arrangement results in an increased resilient resistance of the fingers 4 to the laterally outwardly-directed force component of the sphere 9 moved with the push button 10.

As the equator of the sphere 9 has passed the detent 8, their retaining effect ceases and the ball 9 is forcefully launched — like a projectile — by the accumulated potential energy in the direction of the projecting resetting pin 21.

The downwardly propelled sphere 9 engages the resetting pin 21 in an impact-like manner and with sufficient force to reset the thermostat into its operative, current conducting condition. This phase of operation is illustrated in FIG. 3 from which it is seen that the push button 10 is in its fully depressed position, the resilient fingers 4 have assumed their normal state and the coil spring 13, being out of contact with the floor 11 of the push botton 10, is in a fully relaxed state. Thus, after the sphere 9 has spent its kinetic energy, no forces act thereon and thus the resetting pin 21 is not retained in a depressed condition even if the push button 10 is retained in its fully depressed state.

Thus, should the temperature which the thermostat is designed to monitor, reach the predetermined maximum value, the thermostat is capable of again breaking the electric circuit even if the push button 10 is still in its depressed position.

Upon removing the manual force from the push button 10, the coil spring 20 moves the retaining sleeve 15 and the push button 10 outwardly towards their normal position. As the return sleeve 15 executes this motion, its lifter lugs 16 arrive into engagement with the sphere 9 and raise the latter into the normal position of rest as shown in FIG. 1. It is to be understood that the force of the coil spring 20 should be so designed that it is adapted to overcome the resilient resistance of the spring fingers 4 and thus, acting under the force of the coil spring 20, the return sleeve 15, with the lifter lugs 16, is capable of forcing the sphere 9, by wedging effect, beyond the detents 8 into the position shown in FIG. 1, whereupon the thermostat resetting device is ready for a successive operation.

It is noted that the force of the resilient fingers 4 and the shape of the detent members 8 may be so designed that, as the sphere 9, during the depression of the push button 10, passes with its equator the detent 8, the resilient force of the spring finger 4 imparts a sufficiently large launching force (potential energy) to the sphere 9 to depress the resetting pin 21 without needing the force of the coil spring 13. Thus, in such cases it is feasible to omit the coil spring 13 altogether.

It is to be understood that the resetting device described above can be associated with other types of thermostats where similar resetting problems occur.

It will be understood that the above description of the present invention is susceptible to various modifications, changes and adaptations, and the same are intended to be comprehended within the meaning and range of equivalents of the appended claims.

What is claimed is:

1. A resetting device coupled to a thermostat which has a resetting pin actuated by depressing the same, comprising:

(a) a housing attached to said thermostat; said resetting pin extending into said housing;

(b) a body arranged to be movable within said housing towards and away from said resetting pin;

(c) a manually operable push button movably supported in said housing and having a position of rest, a fully depressed position and an intermediate, actuating position; said push button including a component arranged to engage said body for moving said body, in unison with the motion of said push button, along a portion of its traveling path while an external pressing force is applied to said push button;

(d) propelling means for launching said body in the direction of said resetting pin for depressing said resetting pin by said body by impact-like engagement between said body and said resetting pin; said propelling means being actuated by said push button upon reaching said actuating position from said position of rest; said propelling means comprising (1) resilient force exerting means operatively connected to said push button and said body for imparting potential energy to said body at a location spaced from said resetting pin upon actuation of said push button; said resilient force exerting means including a plurality of resilient fingers held in said housing and defining a space between themselves for accommodating said body;

(2) retaining means projecting into the traveling path of said body for obstructing its motion towards said resetting pin at said location; said retaining means having detents carried by said fingers and projecting into said space at a predetermined distance from said resetting pin for engaging said body; said resilient fingers with said detents constituting a resistance to the motion of said body with said push button, said body accumulating said potential energy during obstruction of its motion by said detents; said detents being arranged for releasing said body at a predetermined position thereof during its travel with said push button; said body being propelled from said predetermined positon away from said component of said push button against said resetting pin by the potential energy on said body;

(3) means for releasing said retaining means for propelling said body against said resetting pin by said energy; and (e) means for maintaining said body out of force-transmitting contact with said push button and said propelling means in said fully depressed position of said push button for providing free mobility of said resetting pin subsequent to said impact-like engagement, irrespective of the position of said push button.

2. A resetting device as defined in claim 1, wherein said body is a sphere; said sphere attaining said predetermined position when said detents engage said sphere along its equator.

3. A resetting device as defined in claim 1, said resilient fingers being fixedly held at a first end thereof and are movable transversely to their length dimension at a second end thereof; said push button having an inner wall face arranged to arrive in engagement with said second ends of said resilient fingers during their outward movement in response to a spreading force exterted thereon by said body travelling with said push button.

4. A resetting device as defined in claim 1, further comprising a spring disposed between said body and said push button to exert a resilient force to said body upon depression of said push button; said spring forming part of said resilient force exerting means.

5. A resetting device as defined in claim 1, further comprising a return member slidably supported in said housing and in engagement with said push button to be displaced by said push button upon depression thereof; said return member having a lifter lug extending into the path of motion of said body and a spring urging said return member in a direction opposing the motion of said push button in response to its depression for returning said body into an initial position by said lifter lug when said push button is released.

* * * * *